US005366389A

United States Patent [19]

Kreutter

[11] Patent Number: 5,366,389

[45] Date of Patent: Nov. 22, 1994

[54] CONNECTOR PEG HOLDOWN

[75] Inventor: Erich Kreutter, Winterbach, Germany

[73] Assignee: ITT Industries, Inc., Secaucus, N.J.

[21] Appl. No.: 64,472

[22] Filed: May 21, 1993

[30] Foreign Application Priority Data

Jun. 4, 1992 [DE] Germany ..... 4218431

[51] Int. Cl.[5] ..... H01R 13/73

[52] U.S. Cl. ..... 439/571

[58] Field of Search ..... 439/571, 572, 733

[56] References Cited

U.S. PATENT DOCUMENTS 5,178,561 1/1993 Lindeberg et al. ..... 439/571

FOREIGN PATENT DOCUMENTS 0017358 3/1980 European Pat. Off. .
3603250 2/1986 Germany .
8702025 2/1987 Germany .
8808153 6/1988 Germany .

*Primary Examiner*—Gary F. Paumen
*Attorney, Agent, or Firm*—Thomas L. Peterson

[57] ABSTRACT

A connector is described, of the type that has a plastic housing with pegs (15, FIG. 2 ) that project through round holes (16) in a circuit board to hold the connector in place, wherein the pegs are shaped to minimize warping of the circuit board and facilitate construction of the pegs. Each peg has an axis (27) and has at least three vertical interference ridges (17–20) each spaced from the axis by slightly more than the radius of the circuit board holes, with the outer surface (28) of each ridge having about the same radius of curvature as that of the board holes. The outer surface of each peg preferably extends by an angle A of at least 15° about an imaginary circle (32) centered on the axis, with the ridges connected by straight sides (21–24), with the straight sides lying on an imaginary regular polygon such as a square (29). Each peg can have a cylindrical lower portion (30, FIG. 4 ) extending below the ridges and closely received in the hole to assure alignment of the ridges with the hole.

5 Claims, 2 Drawing Sheets

CONNECTOR PEG HOLDOWN

BACKGROUND OF THE INVENTION

One method for mounting a connector on a circuit board, is to provide pegs on a connector housing and to drill corresponding holes in the circuit board which receive the pegs. The pegs are constructed to make an interference fit with holes of the circuit board, to securely hold the pegs and therefore the connector in place.

If the pegs are formed of metal, they can have sharp or pointed ridges that cut into and displace the walls of the circuit board hole. However, if the pegs are formed of thermoplastic molded integrally with the rest of the connector housing, then they may not be harder than the material of the circuit board holes. In that case, the interference fit between the pegs and the circuit board holes results in outward deflection of the walls of the holes. Such deflection can lead to warping of the circuit board, especially where the connector has a large number of pegs arranged in a row. A peg design which minimized outward deformation of the circuit board holes while still assuring reliable holding of the pegs in the holes, would be of value.

SUMMARY OF THE INVENTION

In accordance with one embodiment of the present invention, a connector is provided which has a housing with a lower surface that can lie on a circuit board, and that has pegs for projecting through holes of the circuit board. The pegs are designed to lie in slight interference fit with the hole walls. Each of the pegs has an axis and has at least three vertical interference ridges each spaced from the axis by slightly more than the hole radius. The ridges are connected by ridge-connecting sides, with the middle of each side spaced from the axis by less than the hole radius. The outer surface of each ridge has a radius of curvature which is about the same as that of the hole axis. As a result, there is wide area contact between the ridge outer surfaces of a peg and the walls of a board hole. The wide area contact provides high frictional resistance against removal of the peg, even though the difference in radius of the ridge outer surfaces and the peg board holes is slight.

Each of the pegs can be formed with a lower portion having a cylindrical surface of slightly smaller outside radius than the hole radius, to closely fit into the hole and align the peg with the hole, to assure aligned driving of the ridges into the board hole. The peg cross section at the ridges can be formed so the sides that connect the ridges are straight and lie on the sides of an imaginary polygon such as a square. Each of the ridges can form a segment of an imaginary circle of slightly greater radius than the hole radius.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
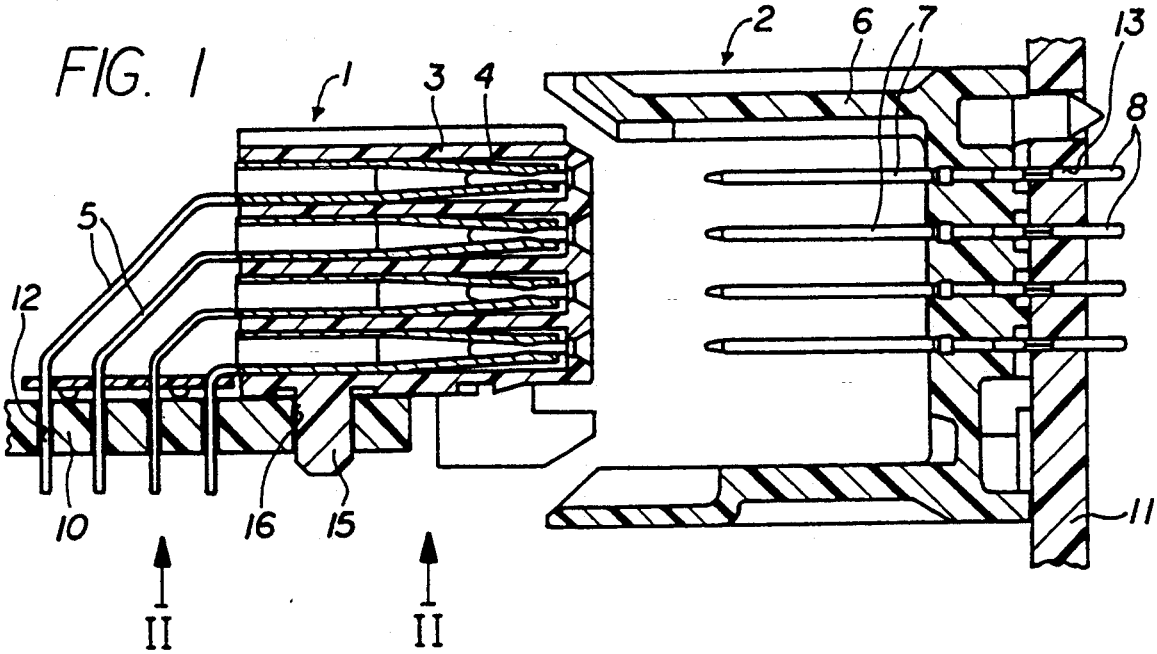
FIG. 1 is a sectional exploded view of a pair of connectors that are each mounted on a circuit board, with one of the connectors and circuit boards constructed in accordance the present invention.

FIG. 1 illustrates a connector arrangement which includes first and second connectors 1, 2 that are mounted on corresponding circuit boards 10, 11. Each connector 1, 2 includes a housing 3, 6 and a plurality of contacts 4, 7 mounted in the housing. The socket contacts 4 of the first connector have rear wire parts 5 that project through plated holes 12 of the circuit board 10. The pin contacts 7 of the second connector have rear wire portions 8 that project through plated holes 13 of the circuit board 11. The connectors are shown aligned and ready to be moved towards each to mate.

Figure 2:
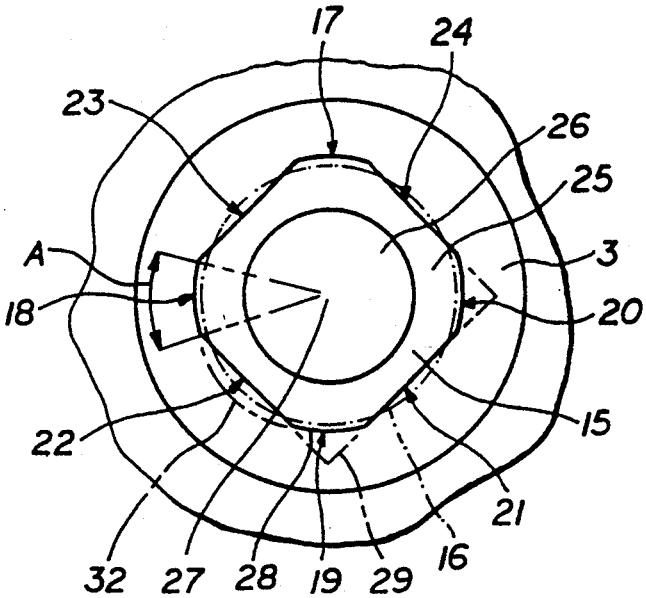
FIG. 2 is a plan view of a bottom of the first connector of FIG. 1 taken on the line II—II of FIG. 1, but with the circuit board not shown.

The first connector 1 includes a main housing portion with a lower surface that lies on the upper surface of the circuit board. The housing also includes a row of pegs 15 that are each received in a round hole 16 that has been drilled through the circuit board. The pegs 15 are relied upon to securely hold the connector in place on the board. As shown in FIG. 2, the peg 15 has an axis 27 which is coincident with the axis of the circuit board hole 16. The peg has four parallel vertically-extending interference ridges 17–20, with each ridge having an outer surface 28 lying further from the axis 27 than the circuit board hole 16. The peg has four ridge-connecting sides 21–24 that each extend between the ridges, with the sides being deemed to start and the ridges to end, where the sides have a radius less than that of the board hole 16. The peg has a lower portion which is conically tapered at 25, and which ends in a lower surface 26.

When the peg is forced down into the board hole, the walls of the board hole are radially outwardly deformed, with the ridges also being slightly inwardly deformed. Both the circuit board 10 and the plastic housing 3 are formed of plastic (a long chain polymer) and have a rigidity, or Young's modulus of elasticity, of the same order of magnitude, such as $200\times10$ spsi. As a result, the pegs may not be hard enough to cut into the board, but instead outwardly deflect the board holes. To minimize warping of the board due to deformation around multiple holes that each receive a peg, applicant constructs each peg so there is a very small interference fit between the peg outer surface 28 and the board hole 16. The resulting small outward deflection of the board hole could result in the pegs providing only a small holding power. However, applicant assures that the pegs will hold securely to the board hole by constructing the outer surface 28 of each ridge so it has a radius of curvature that is about the same as that of the board hole 16. Applicant prefers that the radius of curvature of the peg outer surfaces be within 10% of the board hole radius. In addition, applicant constructs each ridge so its outer surface 28 subtends a large angle A which is preferably at least 15°, with each ridge shown subtending an angle of 30°. The result is a large area of contact between each ridge outer surface 28 and the walls of the board hole 16.

The large area of interference contact between the walls of the board hole 16 and the outer surfaces 28 of the ridges, results in large friction between the pegs and the walls of the board hole, that resists pullout of the peg and therefore of the connector. The board hole location spaced from the ridge-connecting sides 21–24 may deflect inwardly slightly, and to permit this applicant prefers that the angle A of the ridge outer surface does not subtend an angle of much more than about 30° for the four ridged peg of FIG. 2 (a total of 120°). Applicant prefers that the total angle of contact not be more than about one-half circle, or about 180°.

The tooling for the peg can be readily constructed by forming the peg sides 21–24 so they are straight and lie on the sides of an imaginary regular polygon such as a square indicated at 29. The corners of the regular polygon are cut off at an imaginary circle 32, so that all ridge outer surfaces 28 lie on the circle 32 and have the radius of curvature of the circle 32. The foregoing descriptions of the peg are those as would be seen in a sectional view taken along the axis 28, which is similar to that of FIG. 2 except that such a sectional view would not include the tapered part 28 and lower surface 26. The peg with square sides and with the ridge outer surfaces being segments of the same circle 32, not only facilitates manufacture and measurement for precision, but results in large area interference contact with minimal board warping.

In a peg and circuit board arrangement that applicant has designed, each of the board holes has a diameter of 2.05 mm, and each of the peg outer surfaces 28 lay on the surface of an imaginary circle 32 having a diameter of 2.18 mm. The result is a diametrical interference of 0.13 mm, and a radial interference of half as much, or 0.065 mm. The interference is 6.3% of the hole diameter or radius. A smaller interference could be used, except that the amount of interference must be great enough to assure that despite tolerances of the parts, there will always be at least some slight interference. If large diameter pegs are used, then a smaller percent interference can be reliably maintained.

Figure 3:
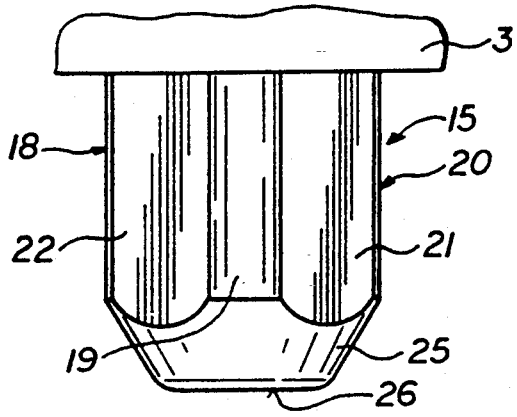
FIG. 3 is a side elevation view of the peg and a portion of the connector of FIG. 2.
Figure 4:
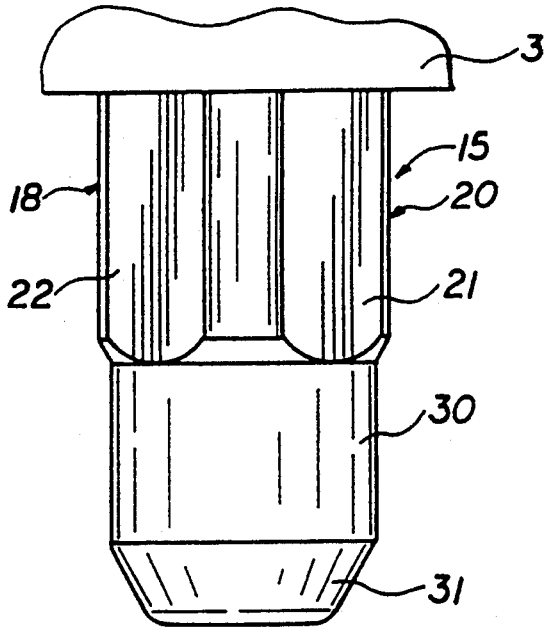
FIG. 4 is a sectional view of a peg and a portion of a connector constructed in accordance with another embodiment of the invention.

FIG. 4 illustrates a peg similar to that of FIGS. 1–3, except that the peg has a lower end portion with a substantially cylindrical outer surface forming a cylindrical guide 30. The cylindrical guide 30 has a radius slightly less than that of each of the board holes, so the guide 30 can readily fit into a board hole and align the peg so the ridges will properly enter the board hole. The radius of the cylindrical guide is greater than the radial distance from the peg axis to the middle of a peg side such 21. The peg has a conically tapered lower end 31 to aid in insertion of the guide 30 into the hole. The vertical length of the guide 30 is preferably at least half its radius, and more preferably at least equal to its radius, to assure that the axis of the peg will lie accurately parallel with the axis of the board hole before the ridges start to enter the board hole. The required length of the cylindrical guide 30 depends upon how closely the guide fits in the board hole, and it is preferred that there be a snug fit.

Figure 5:
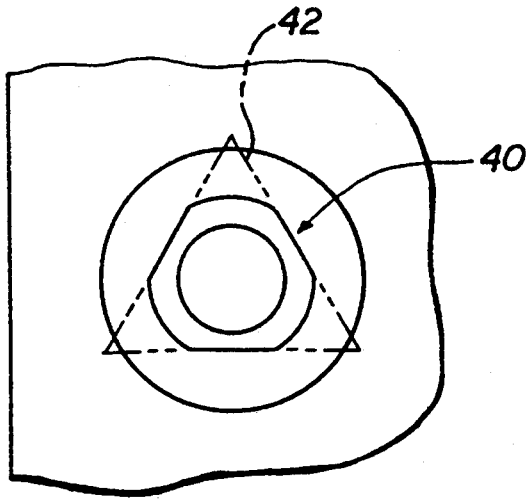
FIG. 5 is a bottom view of a connector with a peg constructed in accordance with another embodiment of the invention.

FIG. 5 illustrates another peg 40 similar to that of FIG. 2, except that it has only three ridges, and the ridge-connecting sides lie on the sides of an imaginary regular polygon which has three sides, it being a triangle indicated at 42. The total angle of contact in FIG. 5 is about 180°.

Figure 6:
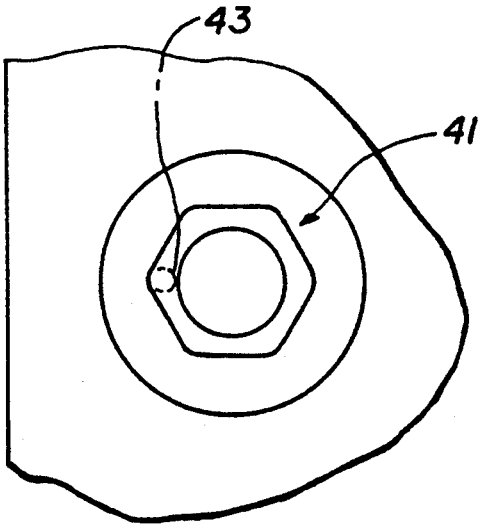
FIG. 6 is a bottom view of a connector with a peg constructed in accordance with another embodiment of the invention.

FIG. 6 illustrates another peg 41 which may hold to a board, but which may require greater board deformation and possibility of significant warping, than the pegs of FIGS. 1–5. The peg 41 has sides lying on an imaginary hexagon, with the corners being rounded, but with the corners lying on an imaginary circle 43 having a diameter about one-fifth the diameter of a circle on which the six corners of the hexagon would lie. Although the hexagonal peg 41 may result in greater warping of a board for a given resistance to pullout of a peg from the board hole, the amount of board warping is still less than obtained for prior art rigid pegs whose cross section is that of a square and which have sharp corners at the corners of the square.

Thus, the invention provides a connector with pegs, which is designed to mount on a circuit board having round holes, wherein the pegs are formed to securely hold to the circuit board with minimal warping of the board. Each of the pegs has a plurality of ridges, preferably no more than six, that each have an outer surface that is designed to lie in interference fit with the walls of the board hole. A slight interference fit results in high resistance to pull out of the peg, by forming each ridge outer surface so it has about the same radius of curvature as that of the board hole. Each ridge outer surface subtends an angle that is preferably at least about 15°, to provide a substantial area of contact of the ridge with the board hole. The sides of the peg which connect the ridges, preferably lie on the sides of an imaginary regular polygon, which facilitates construction and inspection measurements of the peg. The peg can be constructed with a lower portion having a substantially cylindrical surface that lies closely within the board hole, but not in interference fit therewith, to accurately align the peg portion that forms the ridges with the board hole. Although the pegs and their ridges have been described as extending vertically to aid in the description, the connector and circuit board, and therefore the pegs, can be used in any orientation with respect to gravity.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. An electrical connector which is designed to mount to a circuit board which has a plurality of round holes that are each of a predetermined hole radius, comprising:

a connector housing which has a lower surface for lying on said board, and which has a plurality of pegs integral therewith for insertion into said round holes of said board;

each of said pegs has an axis and has at least three vertically-extending interference ridges each spaced from said axis by more than said hole radius, with each peg formed of rigid material and with said ridges being angularly spaced about said peg axis to enable peg insertion into one of said holes only in an interference fit, and each of said pegs has at least three ridge-connecting sides each spaced from said axis by less than said hole radius, with each of said ridges having an outer surface which, as seen in a sectional view taken normal to said axis, has a radius of curvature which is about the same as said hole radius.

2. The connector described in claim 1 wherein:

each of said ridges subtends an angle of at least 15° about said axis.

3. The connector described in claim 1 wherein:

said radius of curvature of said interference ridges is no more than 10% larger than said hole radius.

4. The connector described in claim 1 wherein:

in a sectional view taken normal to said peg axis, each of said ridge-connecting sides are straight and lie on the sides of an imaginary regular polygon, and said ridge outer surfaces are each part of the same imaginary circle which is centered on said axis.

5. The connector described in claim 1 including:

a circuit board having upper and lower faces and a plurality of round holes each having said hole radius;

said connector housing lower surface lies substantially against said board upper surface, and said pegs each project through one of said holes, with said ridges lying within said holes in interference fit therewith.

* * * * *